US010480199B2

(12) United States Patent
Simon

(10) Patent No.: US 10,480,199 B2
(45) Date of Patent: Nov. 19, 2019

(54) FLOORBOARDS WITH HORIZONTALLY AND VERTICALLY LOCKING CONNECTING PROFILES

(71) Applicant: Tarkett GDL S.A., Lentzweiler (LU)

(72) Inventor: Jean-Yves Simon, Wiltz (LU)

(73) Assignee: Tarkett GDL S.A., Lentzweiler (LU)

( * ) Notice: Subject to any disclaimer, the term of this patent is extended or adjusted under 35 U.S.C. 154(b) by 0 days.

(21) Appl. No.: 15/735,805

(22) PCT Filed: Jun. 22, 2016

(86) PCT No.: PCT/EP2016/064478
§ 371 (c)(1),
(2) Date: Dec. 12, 2017

(87) PCT Pub. No.: WO2016/207251
PCT Pub. Date: Dec. 29, 2016

(65) Prior Publication Data

US 2019/0106887 A1 Apr. 11, 2019

Related U.S. Application Data

(60) Provisional application No. 62/185,187, filed on Jun. 26, 2015.

(51) Int. Cl.
*E04F 15/02* (2006.01)

(52) U.S. Cl.
CPC ..... *E04F 15/02038* (2013.01); *E04F 2201/0153* (2013.01); *E04F 2201/0161* (2013.01); *E04F 2201/02* (2013.01); *E04F 2201/043* (2013.01)

(58) Field of Classification Search
CPC ..... E04F 15/02038; E04F 2201/0153; E04F 2201/043; E04F 2201/02; E04F 2201/0161
See application file for complete search history.

(56) References Cited

U.S. PATENT DOCUMENTS 7,841,150 B2 11/2010 Pervan
7,892,617 B2 2/2011 Bathelier et al.
(Continued)

FOREIGN PATENT DOCUMENTS

DE 10 2005 043 721 A1 4/2007
EP 1898026 A2 2/2004
(Continued)

*Primary Examiner* — Christine T Cajilig
(74) *Attorney, Agent, or Firm* — Reinhart Boerner Van Deuren P.C.

(57) ABSTRACT

The invention relates to a floorboard for a flooring system comprising a plurality of mechanically connectable floorboards. The floorboard comprises a first connecting profile along a first side and a second connecting profile along a second side that is parallel to the first side. The first connecting profile is configured for locking engagement with the second connecting profile of another floorboard both horizontally and vertically. The first connecting profile comprises a protruding strip at the bottom face of the floorboard, the protruding strip terminating outwardly in a locking element projecting towards the top face of the floor board. The second connecting profile comprises an overhanging tongue delimiting at its bottom a recess for receiving the protruding strip, the recess comprising a locking groove configured for cooperating with the locking element so as to provide a horizontal locking effect. The first connecting profile comprises a tongue groove arranged above a stem portion of the protruding strip. The tongue groove is configured to accommodate the tip of the overhanging tongue so as to provide a vertical locking effect. The overhanging tongue comprises an upper contact surface and a lower contact surface that are inclined with respect to each other. Complementarily, the tongue groove is delimited by an upper delimiting surface and a lower delimiting surface. The upper and lower contact surface of the overhanging
(Continued)

tongue are configured to be put into contact with the upper and lower delimiting surface, respectively, of the tongue groove.

20 Claims, 7 Drawing Sheets

(56) References Cited

U.S. PATENT DOCUMENTS 8,261,508 B2 * 9/2012 Thiers ..... E04F 15/02 428/192
2002/0020127 A1 * 2/2002 Thiers ..... E04F 15/02 52/403.1
2003/0024200 A1 * 2/2003 Moriau ..... B27F 1/06 52/592.1
2005/0166514 A1 * 8/2005 Pervan ..... B27F 5/026 52/578
2006/0156672 A1 * 7/2006 Laurent ..... B44C 3/005 52/589.1
2006/0260254 A1 * 11/2006 Pervan ..... E04F 15/02 52/592.1
2009/0193741 A1 * 8/2009 Cappelle ..... E04F 15/02 52/309.1
2009/0260313 A1 * 10/2009 Segaert ..... E04F 15/02 52/592.1
2011/0131916 A1 * 6/2011 Chen ..... E04F 15/02 52/588.1
2013/0309441 A1 * 11/2013 Hannig ..... E04F 15/02038 428/100

FOREIGN PATENT DOCUMENTS

EP 2275615 A2 1/2011
WO WO 2004/016876 A2 2/2004
WO WO-2004016876 A2 * 2/2004 ..... E04F 13/10
WO WO-2009077178 A1 * 6/2009 ..... E04F 15/02
WO WO 2011/028171 A1 3/2011
WO WO-2016042142 A1 * 3/2016 ..... E04F 15/105

* cited by examiner

FLOORBOARDS WITH HORIZONTALLY AND VERTICALLY LOCKING CONNECTING PROFILES

FIELD OF THE INVENTION

The invention generally relates to the technical field of flooring. The invention more specifically concerns floorboards having horizontally and vertically locking connecting profiles arranged on their sides.

SUMMARY OF THE INVENTION

A first aspect of the invention relates to a floorboard for a flooring system comprising a plurality of mechanically connectable floorboards. The floorboard comprises a first connecting profile along a first side (edge) and a second connecting profile along a second side that is parallel to the first side. The first connecting profile is configured for locking engagement with the second connecting profile of another floorboard both horizontally and vertically. (Likewise, the second connecting profile is configured for locking engagement with the first connecting profile of another floorboard.) The first connecting profile comprises a protruding strip at the bottom face of the floorboard, the protruding strip terminating outwardly in a locking element projecting towards the top face of the floorboard. The second connecting profile comprises an overhanging tongue delimiting at its bottom a recess for receiving the protruding strip, the recess comprising a locking groove configured for cooperating with the locking element so as to provide a horizontal locking effect. The first connecting profile comprises a tongue groove arranged above a stem portion of the protruding strip. By stem portion, we mean the "proximal" part of the protruding strip that is connected on one end to the main body of the floorboard and that does not include the locking element, to which it is connected on the other end. The tongue groove is configured to accommodate the tip of the overhanging tongue so as to provide a vertical locking effect. The overhanging tongue comprises an upper contact surface and a lower contact surface that are inclined with respect to each other. Complementarily, the tongue groove is delimited by an upper delimiting surface and a lower delimiting surface. The upper and lower contact surface of the overhanging tongue are configured to be put into contact with the upper and lower delimiting surface, respectively, of the tongue groove.

Preferably, the (virtual) intersection axis of the contact surfaces of the tongue lies outside of the respective floorboard. The (virtual) intersection axis of the upper and lower delimiting surfaces of the tongue groove preferably lies within the respective floorboard. It may be worthwhile noting that the above-mentioned intersection axes of two neighboring floorboards substantially coincide when the floorboards are connected.

The angles between the upper contact surface and the lower contact surface and between the upper delimiting surface and the lower delimiting surface are preferably comprised in the range from 2° to 30°, more preferably in the range from 3° to 25°, and even more preferably in the range from 3° to 20°.

According to an embodiment, the tip of the overhanging tongue has a (substantially) horizontal upper contact surface and the upper delimiting surface of the tongue groove is also (substantially) horizontal.

According to an embodiment, the stem portion of the protruding strip has a horizontal lower surface which forms part of the back face of the floorboard.

The floorboard can be of any suitable flooring material. Preferably, the floorboard is a wood flooring panel, a laminate flooring panel, a polymer-based flooring panel or a mineral-material (e.g. geopolymer or fibre cement) based flooring panel. In case of a polymer-based flooring panel, a vinyl flooring panel or a PVC-free thermoplastic flooring panel is preferred.

The floorboard may, for instance, be a luxury vinyl tile (LVT).

According to an embodiment, the floorboard comprises a third connecting profile along a third side and a fourth connecting profile along a fourth side, which is parallel to the third side. The third and fourth connecting profiles are preferable configured like the first and second connecting profiles, respectively. In particular, the third connecting profile is configured for locking engagement with the fourth connecting profile of another floorboard both horizontally and vertically. Like the first connecting profile, the third connecting profile comprises a protruding strip at the bottom face of the floorboard, the protruding strip terminating in a locking element projecting towards the top face of the floorboard. Like the second connecting profile, the fourth connecting profile comprises an overhanging tongue delimiting at its bottom a recess for receiving the protruding strip, the recess comprising a locking groove configured for cooperating with the locking element so as to provide a horizontal locking effect. The third connecting profile also comprises a tongue groove arranged above a stem portion of the protruding strip, the tongue groove being configured to accommodate the tip of the overhanging tongue so as to provide a vertical locking effect. The overhanging tongue comprises an upper contact surface and a lower contact surface that are inclined with respect to each other. Complementarily, the tongue groove is delimited by an upper delimiting surface and a lower delimiting surface. The upper and lower contact surface of the overhanging tongue are configured to be put into contact with the upper and lower delimiting surface, respectively, of the tongue groove.

According to an embodiment, the first and third connecting profiles on the one hand and the second and fourth connecting profiles on the other hand may be differently dimensioned.

According to an embodiment, the first and third connecting profiles on the one hand and the second and fourth connecting profiles on the other hand are identical. In this case, one could connect the first connecting profile of a first floorboard to either the second or the fourth connecting profile of a second floorboard and the same is true for the third connecting profile.

According to an embodiment, the floorboard has a height from the bottom face to the top face comprised in the range from 2.5 mm to 20 mm, preferably in the range from 4 mm to 15 mm.

A further aspect of the invention relates to a flooring system that comprises a plurality of floorboards described hereinabove.

BRIEF DESCRIPTION OF THE DRAWINGS

By way of example, preferred, non-limiting embodiments of the invention will now be described in detail with reference to the accompanying drawings, in which.

DETAILED DESCRIPTION OF PREFERRED EMBODIMENTS

Figure 1:
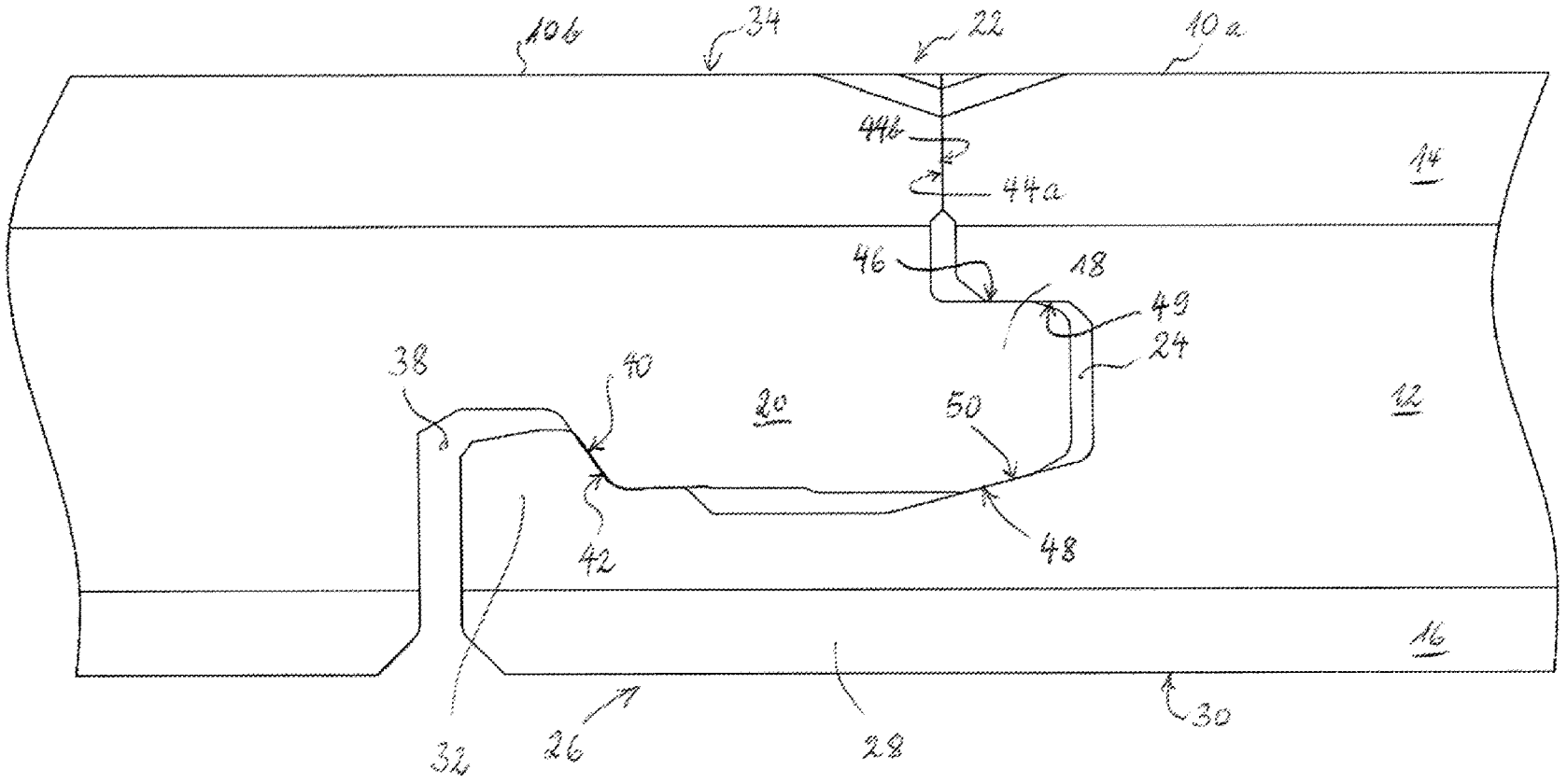
FIG. 1: is a cross-sectional view of two floorboards according to an aspect of the invention joined by their connecting profiles extending along their edges.

FIG. 1 illustrates an embodiment of the invention in the form of a wood or wood veneer (also called "engineered wood") flooring system. FIG. 1 specifically shows the mechanical connection between a first floorboard 10*a* and a second floorboard 10*b*.

Each floorboard 10*a*, 10*b* comprises a structural body layer 12 consisting of fibreboard (e.g. high or medium density fibreboard) or wood, a top surface layer 14 and a balancing layer 16 at the back face. The surface layer provides appearance and durability to the floorboards 10*a*, 10*b* and has a thickness comprised in the range from, e.g., 0.15 to 1 mm in case of wood veneer or 2 to 5 mm in case of parquet. The structural body layer typically has a thickness in the range from, e.g., 3 to 8 mm and provides stability. The balancing layer is intended to keep the floorboard level when environmental conditions (e.g. relative humidity, temperature) vary.

The floorboards 10*a*, 10*b* are connected by complementarily shaped connecting profiles at the long and short sides of the floorboards. When the flooring is laid, the floorboards are brought together by inserting the tip 18 of the tongue 20 of the second connecting profile 22 of the floorboard to be installed into the corresponding tongue groove 24 of the first connecting profile 26 of an already installed floorboard. To do this, the floorboard to be installed is held inclined with respect to the floor and then brought into its final position in a rotational and, possibly, slightly translational, movement.

As already indicated, the first connecting profile 26 comprises a tongue groove 24, which is delimited to the bottom by a protruding strip 28. The protruding strip is arranged at the bottom face 30 of the floorboard 10*a* and terminates in a locking element 32 that projects towards the top face 34 of the floorboard. The second connecting profile 22 comprises the overhanging tongue 20, which delimits at its bottom a recess for receiving the protruding strip 28. At its proximal end, the recess comprises a locking groove 38 configured for cooperating with the locking element 32 of the protruding strip. When properly inserted into the locking groove 38, the locking element 32 and the locking groove cooperate to provide a horizontal locking effect. Specifically, the inwardly turned side surface 40 of the locking element 32 comes into abutment with the corresponding inwardly turned surface 42 on the bottom side of the tongue 20, so that the joined connecting profiles are prevented from separating horizontally. In the opposite direction, movement is blocked by the frontal top edges 44*a*, 44*b* of the first and second connecting profiles being in contact with each other.

The tongue groove 24 is configured to accommodate the tip 18 of the tongue 20, thereby providing a vertical locking of the connected profiles.

In the embodiment of FIG. 1, the tip 18 of the tongue 20 comprises an upper contact surface 46 and a lower contact surface 48 that are inclined with respect to each other. The (virtual) intersection axis of both surfaces 46, 48 lies outwardly from the floorboard to which the tongue 20 belongs. Whereas the upper contact surface 46 is horizontal, the lower contact surface is slanted. The inclination angles of the lower surface may be different on the long side and the short side of the floorboard. The tongue groove 24 is delimited to the top by a substantially horizontal upper delimiting surface 49 and to the bottom by an inclined lower delimiting surface 50. The upper 46 and lower 48 contact surface of the overhanging tongue 20 are configured and arranged for contacting the upper 49 and lower 50 delimiting surface, respectively, of the tongue groove 24 when the connecting profiles 22 and 26 are engaged.

Figure 2:
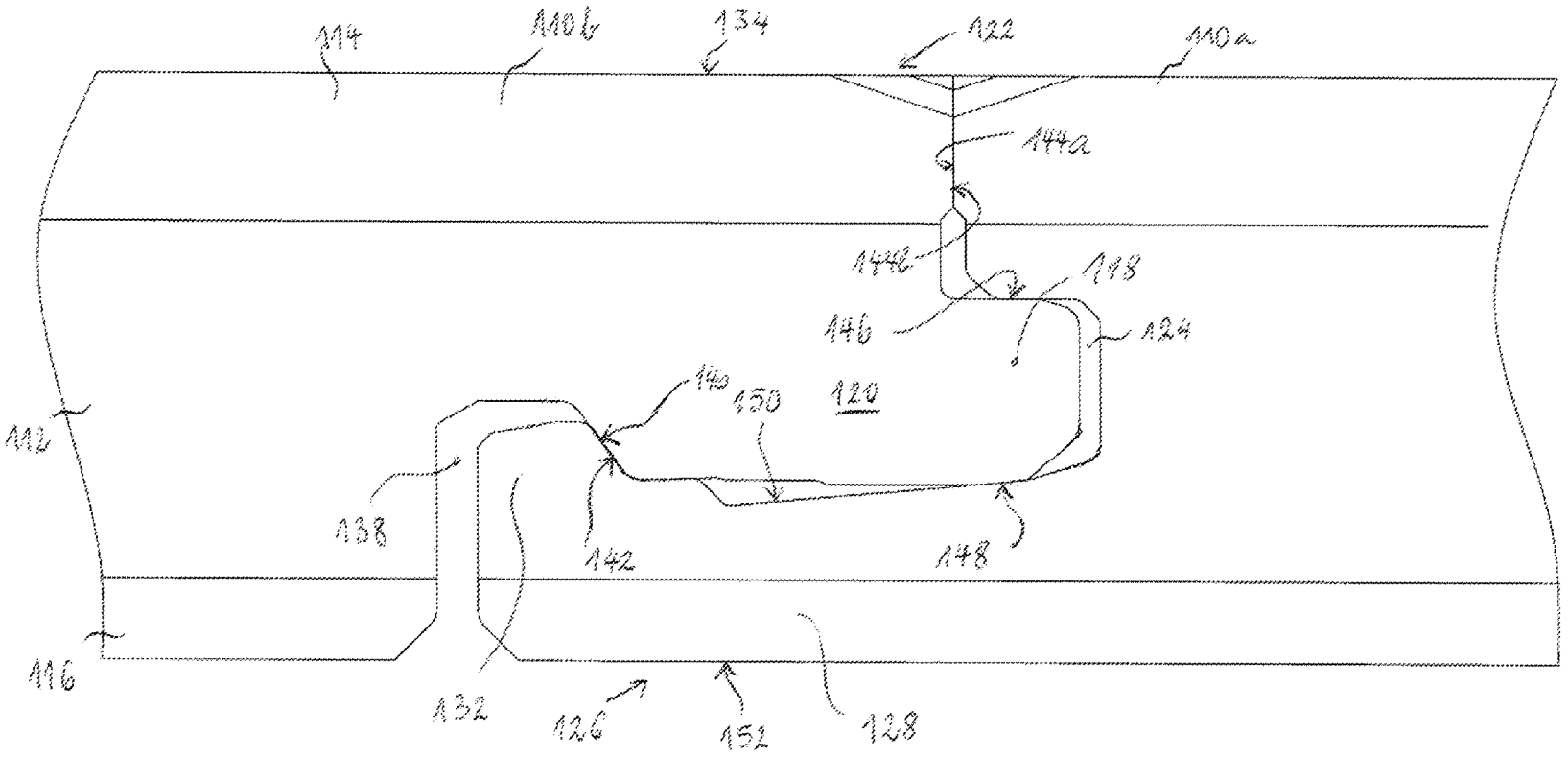
FIG. 2: is a cross-sectional view of another variant of floorboards according to an aspect of the invention.

FIG. 2 shows the mechanical connection between a first floorboard 110*a* and a second floorboard 110*b*.

Each floorboard 110*a*, 110*b* comprises a structural body layer 112 consisting of fibreboard (e.g. high or medium density fibreboard) or wood, a top surface layer 114 and a balancing layer 116 at the back face. The thicknesses of the different layers may be as in the embodiment of FIG. 1.

The floorboards 110*a*, 110*b* are connected by complementarily shaped connecting profiles at the long and short sides of the floorboards. The configuration of the connecting profiles is generally the same as in the embodiment of FIG. 1 but with slight differences.

The tongue 120 of the second connection profile 122 is similar to the tongue 20 of the embodiment of FIG. 1 but its underside is shaped slightly differently. Starting from the tip of the tongue, the slope of the underside first has a relatively steep slope, followed by a segment with a lesser slope, which forms the lower contact surface 148 of the tongue 120. Farther away from the tip, the underside of the tongue 120 becomes substantially horizontal. The upper contact surface 146 of the tongue tip is substantially horizontal. The same is valid, mutatis mutandis, for the corresponding tongue groove 124 of the first connection profile. The tongue groove 124 is configured to accommodate the tip 118 of the tongue 20, thereby providing a vertical locking of the connected profiles 122, 126.

The protruding strip 128 is configured differently than that of FIG. 1. In its stem portion, the protruding strip 128 comprises a sloping upper surface 150, which forms an angle with the lower surface 152. The upper surface 150 of the stem portion of the protruding strip also provides the lower delimiting surface of the tongue groove, which enters into contact with the lower contact surface 148 of the tongue tip 118. The upper delimiting surface 149 of the tongue groove 124 is provided by a substantially horizontal bottom side of the frontal top edge 144*a* of the first connecting profile 126.

The protruding strip 128 terminates in a locking element 132 projecting towards the top face 134 of the floorboard. The overhanging tongue 120 of the second connecting profile 122 delimits at its bottom a recess for receiving the protruding strip 128. At its proximal end, the recess comprises a locking groove 138 configured for cooperating with the locking element 132 of the protruding strip. When properly inserted into the locking groove 138, the locking element 132 cooperates with the locking groove 138 to provide a horizontal locking effect. Specifically, the inwardly turned side surface 140 of the locking element 132 comes into abutment with the corresponding inwardly turned surface 142 on the bottom side of the tongue 120, so that the joined connecting profiles are prevented from separating horizontally. In the opposite direction, movement is blocked by the frontal top edges 144*a*, 144*b* of the first and second connecting profiles being in contact with each other.

Figure 3:
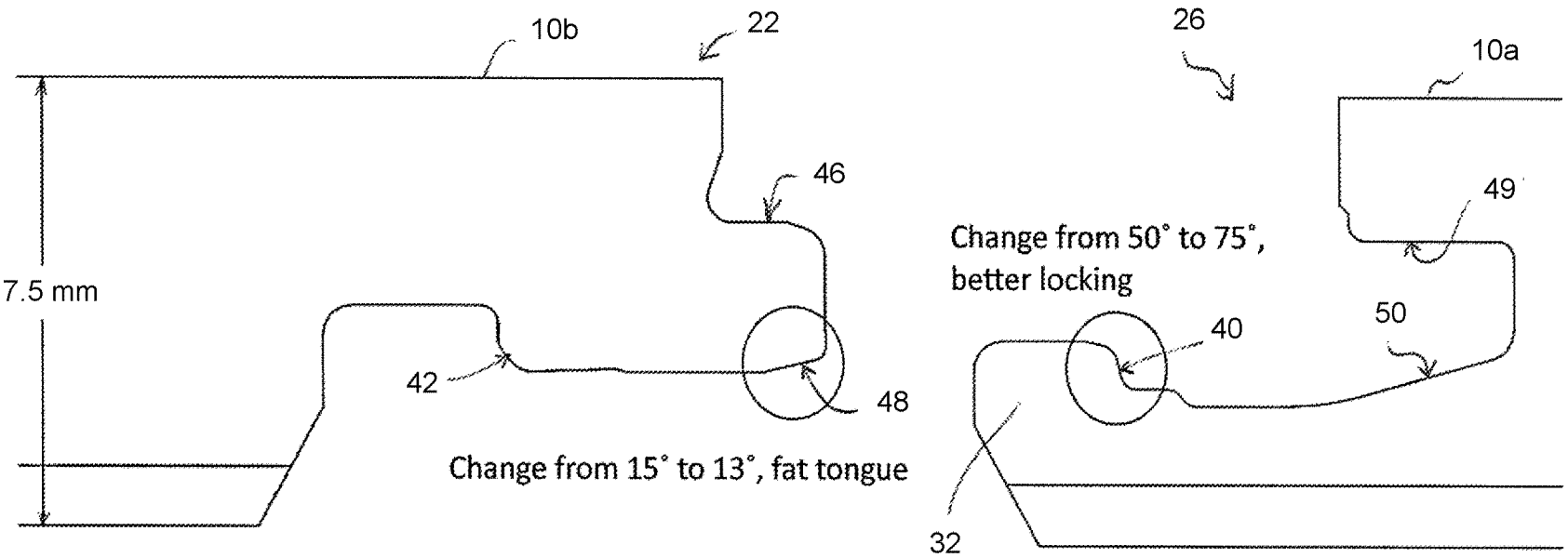
FIG. 3: is a cross-sectional view of a variant of the floorboards of FIG. 1 optimized for laminate flooring.

FIG. 3 illustrates possible variations of the connecting profiles 22 and 26 of FIG. 1 to optimize them for laminate flooring: the slope of the lower surface of the tip of the so-called "fat" tongue 48 is reduced from 15° (for wood floorboard) to 13° (for laminate floorboard) and the slope of the inwardly turned side surface 40 of the locking element 132 is increased from 50° (for wood floorboard) to 75° (for laminate floorboard).

Figure 4:
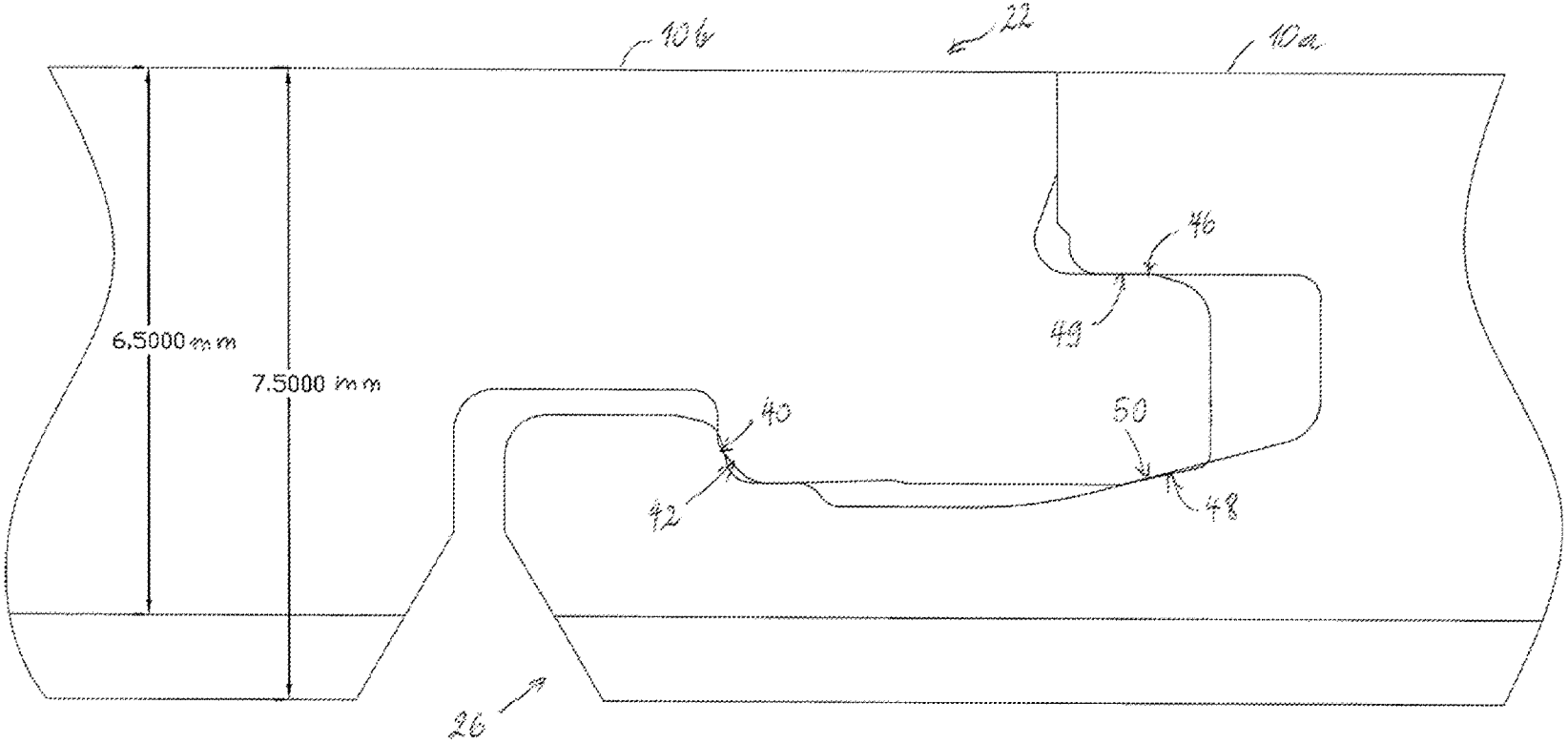
FIG. 4: is a cross-sectional view of the floorboards of FIG. 3 in the connected state.

FIG. 4 shows the variants of the connecting profiles 22 and 26 presented in FIG. 3 in the connected state.

Figure 5:
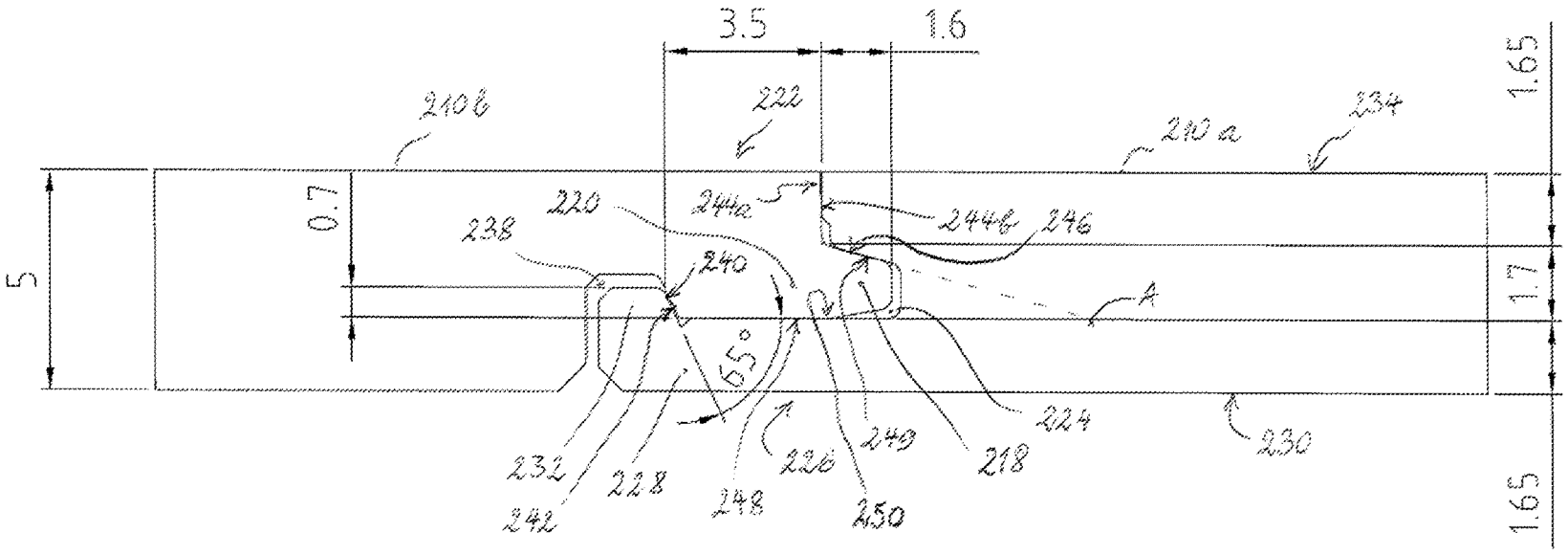
FIG. 5: is a cross-sectional view of LVT floorboards according to an aspect of the invention.

FIG. 5 illustrates two connection profiles particularly suited for floorboards made from LVT material. Each floorboard 210*a*, 210*b* comprises a structural vinyl body layer, a decorative top (including, e.g. a vinyl wear layer and, possibly, a urethane top coating that improves resistance to abrasion) and a balancing layer at the back face. The surface layer provides appearance and durability to the floorboards 210*a*, 210*b*. The balancing layer is intended to keep the floorboard level when environmental conditions (e.g. relative humidity, temperature) vary. The entire thickness of the LVT floorboards amounts to 5 mm.

The floorboards 210*a*, 210*b* are connected by complementarily shaped connecting profiles 222, 226 at the long and short sides of the floorboards. When the flooring is laid, the floorboards are brought together by inserting the tip 218 of the tongue 220 of the second connecting profile 222 of the floorboard to be installed into the corresponding tongue groove 224 of the first connecting profile 226 of an already installed floorboard. To do this, the floorboard to be installed is held inclined with respect to the floor and then brought into its final position in a rotational and, possibly, slightly translational, movement.

As already indicated, the first connecting profile 226 comprises a tongue groove 224, which is delimited to the bottom by a protruding strip 228. The protruding strip 228 is arranged at the bottom face 230 of the floorboard 210a and terminates in a locking element 232 projecting towards the top face 234 of the floorboard. The second connecting profile 222 comprises the overhanging tongue 220, which delimits at its bottom a recess for receiving the protruding strip 228. At its proximal end, the recess comprises a locking groove 238 configured for cooperating with the locking element 232 of the protruding strip. When properly inserted into the locking groove 238, the locking element 232 cooperates with the locking groove 238 to provide a horizontal locking effect. Specifically, the inwardly turned side surface 240 of the locking element 232 comes into abutment with the corresponding inwardly turned surface 242 on the bottom side of the tongue 220, so that the joined connecting profiles are prevented from separating horizontally. In the opposite direction, movement is blocked by the frontal top edges 244*a*, 244*b* of the first and second connecting profiles being in contact with each other.

The tongue groove 224 is configured to accommodate the tip 218 of the tongue 220, thereby providing a vertical locking of the connected profiles.

The tongue 220 comprises an upper contact surface 246 and a lower contact surface 248 that are inclined with respect to each other. The (virtual) intersection axis A of both surfaces 246, 248 lies outside of the floorboard to which the tongue 220 belongs. The tongue groove 224 is delimited to the top by an upper delimiting surface 249 having the same slope as contact surface 246 and to the bottom by a substantially horizontal lower delimiting surface 250. The upper 246 and lower 248 contact surface of the overhanging tongue 220 are configured and arranged for contacting the upper 249 and lower 250 delimiting surface, respectively, of the tongue groove 224 when the connecting profiles 222 and 226 are engaged.

As shown in FIG. 5, the tip 218 of the tongue 220 and the corresponding tongue groove 224 have a height corresponding approximately to one third of the entire thickness of the LVT floorboard. Both the tip 218 and the tongue groove 224 are located approximately in the middle of the height of the LVT floorboard.

Figure 6:
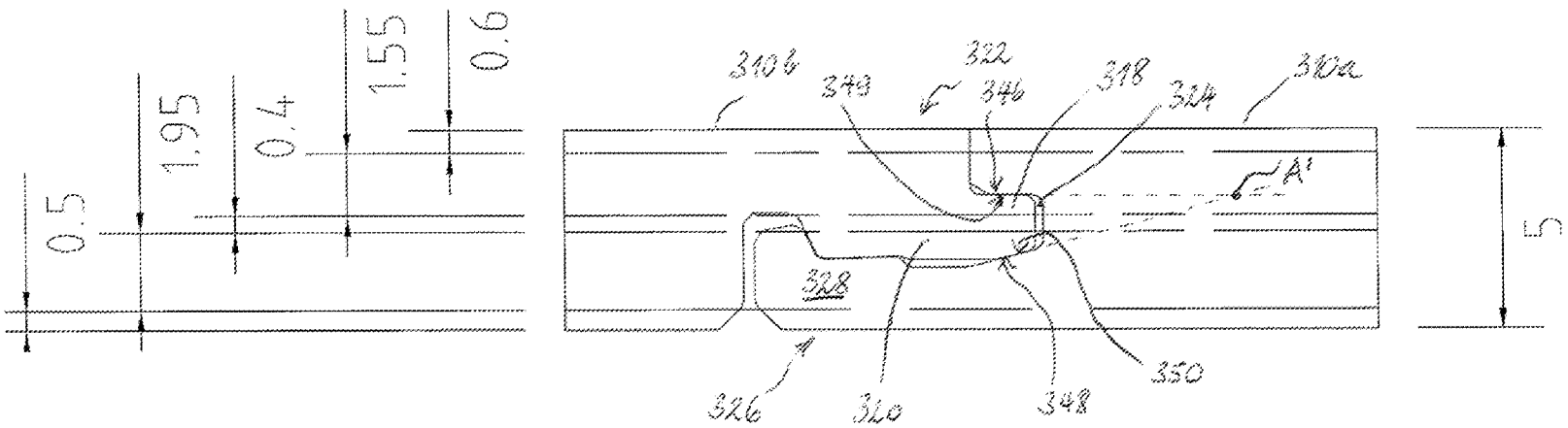
FIG. 6: is a cross-sectional view of further LVT floorboards according to an aspect of the invention.

FIG. 6 shows alternative connection profiles particularly suited for floorboards made from LVT material.

The floorboards 310*a*, 310*b* are connected by complementarily shaped connecting profiles at the long and short sides of the floorboards. The configuration of the connecting profiles is generally the same as in the embodiment of FIG. 5 but with some differences, which are discussed below.

The tongue 320 of the second connecting profile 322 has a horizontal upper contact surface 346 and an inclined lower contact surface 348. The protruding strip 328 of the first connecting profile 326 is configured differently than that of FIG. 5. In its stem portion, the protruding strip 328 comprises a sloping upper surface 350, which provides the lower delimiting surface of the tongue groove 324. The tongue groove 324 is delimited to the top by a substantially horizontal upper delimiting surface 349. The (virtual) intersection axis A' of both surfaces 346, 348 lies outwardly from the floorboard to which the tongue 320 belongs.

Figure 7:
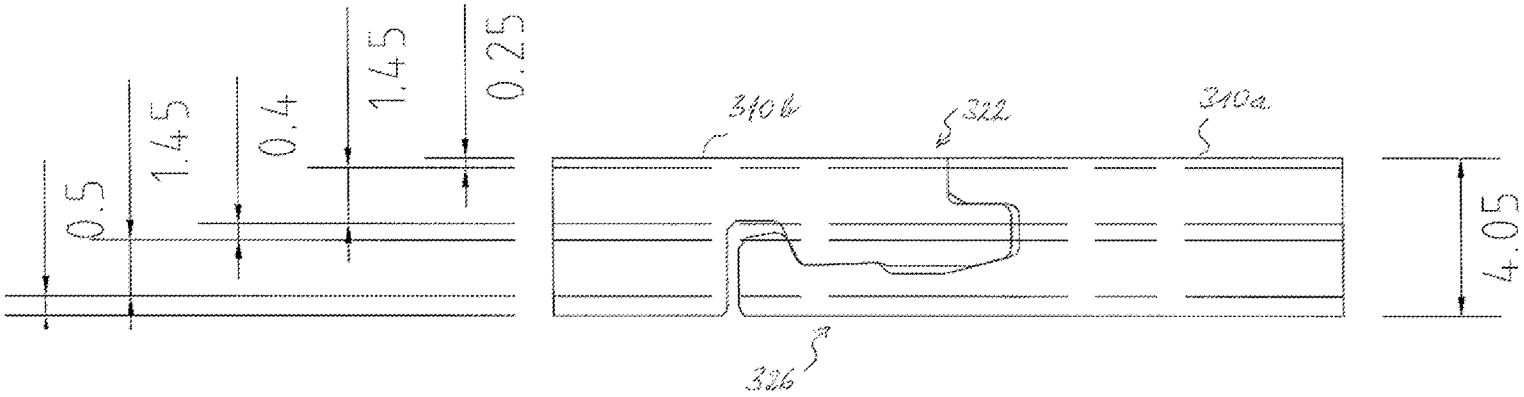
FIG. 7: is a cross-sectional view of a thinner variant of the LVT floorboards of FIG. 6.

FIG. 7 shows a variant of the LVT floorboards of FIG. 6 with reduced overall thickness. The connecting profiles 326 and 322 are identically shaped. The reader is thus invited to refer to the description above for details thereon.

While specific embodiments have been described herein in detail, those skilled in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

The invention claimed is:

1. A floorboard for a flooring system comprising a plurality of mechanically connectable floorboards, the floorboard comprising a bottom face and a top face, a first connecting profile along a first side and a second connecting profile along a second side, which is parallel to the first side, the first connecting profile being configured for locking engagement with the second connecting profile of another floorboard both horizontally and vertically, wherein the first connecting profile comprises a protruding strip having a horizontal bottom surface that is part of the bottom face of the floorboard, the protruding strip terminating in a locking element projecting towards the top face of the floorboard so that the protruding strip has its biggest thickness at the locking element;

wherein the second connecting profile comprises an overhanging tongue delimiting at its bottom a recess for receiving the protruding strip, the recess comprising a locking groove configured for cooperating with the locking element so as to provide a horizontal locking effect, the overhanging tongue comprising a tip;

wherein the first connecting profile comprises a tongue groove arranged above a stem portion of the protruding strip, the tongue groove being configured to accommodate the tip of the overhanging tongue so as to provide a vertical locking effect;

wherein the tip of the overhanging tongue comprises an upper contact surface and a lower contact surface that are inclined with respect to each other so as to define a first virtual intersection axis that lies outside the respective floorboard;

wherein the tongue groove is delimited by an upper delimiting surface and a lower delimiting surface that are inclined with respect to each other, so as to define a second virtual intersection axis that lies inside the respective floorboard;

wherein the upper and lower contact surface of the tip of the overhanging tongue are configured to be put into contact with the upper and lower delimiting surface, respectively, of the tongue groove, so that said first virtual intersection axis substantially coincides with said second virtual intersection axis, when the first connecting profile is in locking engagement with the second connecting profile of another floorboard;

wherein the lower contact surface and the lower delimiting surface are inclined relative to a horizontal plane; and wherein the upper contact surface and the lower contact surface define an angle therebetween that is comprised in the range from 3° to 20°, while the upper delimiting surface and the lower delimiting surface also define an angle therebetween that is comprised in the range from 3° to 20°.

2. The floorboard as claimed in claim 1, wherein the tip of the overhanging tongue has a horizontal upper contact surface and wherein the upper delimiting surface of the tongue groove is also horizontal.

3. The floorboard as claimed in claim 1, wherein the floorboard is a wood flooring panel.

4. The floorboard as claimed in claim 1, wherein the floorboard is a laminate flooring panel.

5. The floorboard as claimed in claim 1, wherein the floorboard is a polymer-based flooring panel.

6. The floorboard as claimed in claim 5, wherein the floorboard is a vinyl tile.

7. The floorboard as claimed in claim 1, wherein the floorboard is a fibre-cement-based flooring panel.

8. The floorboard as claimed in claim 1, wherein the floorboard is a geopolymer-based flooring panel.

9. The floorboard as claimed in claim 1, comprising a third connecting profile along a third side and a fourth connecting profile along a fourth side, which is parallel to the third side, the third connecting profile being configured for locking engagement with the fourth connecting profile of another floorboard both horizontally and vertically, wherein the third connecting profile comprises a protruding strip at the bottom face of the floorboard, the protruding strip terminating in a locking element projecting towards the top face of the floorboard;

wherein the fourth connecting profile comprises an overhanging tongue delimiting at its bottom a recess for receiving the protruding strip, the recess comprising a locking groove configured for cooperating with the locking element so as to provide a horizontal locking effect;

wherein the third connecting profile comprises a tongue groove arranged above a stem portion of the protruding strip, the tongue groove being configured to accommodate the tip of the overhanging tongue so as to provide a vertical locking effect;

wherein the overhanging tongue comprises an upper contact surface and a lower contact surface that are inclined with respect to each other, wherein the tongue groove is delimited by an upper delimiting surface and a lower delimiting surface, and wherein the upper and lower contact surface of the overhanging tongue are configured to be put into contact with the upper and lower delimiting surface, respectively, of the tongue groove.

10. The floorboard as claimed in claim 9, wherein the first and third connecting profiles on the one hand and the second and fourth connecting profiles on the other hand are differently dimensioned.

11. The floorboard as claimed in claim 9, wherein the first and third connecting profiles on the one hand and the second and fourth connecting profiles on the other hand are identical.

12. The floorboard as claimed in claim 1, having a height from the bottom face to the top face comprised in the range from 4 mm to 15 mm.

13. A flooring system, comprising a plurality of floorboards as claimed in claim 1.

14. A fibre-cement-based flooring panel for a flooring system comprising a plurality of mechanically connectable panels, the panel comprising a bottom face and a top face, a connecting profile along a first side and a second connecting profile along a second side, which is parallel to the first side, the first connecting profile being configured for locking engagement with the second connecting profile of another panel both horizontally and vertically;

wherein the first connecting profile comprises a protruding strip having a horizontal bottom surface that is part of the bottom face of the floorboard, the protruding strip terminating in a locking element projecting towards the top face of the floorboard so that the protruding strip has its biggest thickness at the locking element;

wherein the second connecting profile comprises an overhanging tongue delimiting at its bottom a recess for receiving the protruding strip, the recess comprising a locking groove configured for cooperating with the locking element so as to provide a horizontal locking effect;

wherein the first connecting profile comprises a tongue groove arranged above a stem portion of the protruding strip, the tongue groove being configured to accommodate a tip of the overhanging tongue so as to provide a vertical locking effect;

wherein the overhanging tongue comprises an upper contact surface and a lower contact surface that are inclined with respect to each other, wherein the tongue groove is delimited by an upper delimiting surface and a lower delimiting surface, and wherein the upper and lower contact surface of the overhanging tongue are configured to be put into contact with the upper and lower delimiting surface, respectively, of the tongue groove, when the first connecting profile is in locking engagement with the second connecting profile of another panel.

15. The fibre-cement-based flooring panel as claimed in claim 14, wherein the upper contact surface and the lower contact surface define an angle therebetween that is comprised in the range from 3° to 20°, while the upper delimiting surface and the lower delimiting surface also define an angle therebetween that is comprised in the range from 3° to 20°.

16. The fibre-cement-based flooring panel as claimed in claim 14, wherein:

the tongue has a tip that is received in the corresponding tongue groove, and the tip of the tongue and the corresponding tongue groove have a maximum height corresponding approximately to one third of the entire thickness of the floorboard.

17. The fibre-cement-based flooring panel as claimed in claim 14, wherein the lower contact surface and the lower delimiting surface are inclined relative to a horizontal plane by an angle of 13°.

18. The floorboard as claimed in claim 1, wherein the tip of the tongue and the corresponding tongue groove have a height corresponding approximately to one third of the entire thickness of the floorboard.

19. The floorboard as claimed in claim 1, wherein the inclination angle of the lower contact surface and the horizontal plane amounts to 13°.

20. The floorboard as claimed in claim 1, comprising:

a structural body layer providing stability, and a top surface layer providing appearance and durability to the floorboard;

wherein the structural body layer has a thickness in the range from 3 to 8 mm; and the first and second connection profiles are incorporated into the edges of the structural body layer.

* * * * *